US009781989B2

(12) United States Patent
Yamasaki

(10) Patent No.: US 9,781,989 B2
(45) Date of Patent: Oct. 10, 2017

(54) DRAWING APPARATUS, OPERATION CONTROL METHOD OF DRAWING APPARATUS, AND OPERATION CONTROL PROGRAM OF DRAWING APPARATUS

(71) Applicant: CASIO COMPUTER CO., LTD., Shibuya-ku, Tokyo (JP)

(72) Inventor: Shuichi Yamasaki, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/091,528

(22) Filed: Apr. 5, 2016

(65) Prior Publication Data

US 2016/0374452 A1 Dec. 29, 2016

(30) Foreign Application Priority Data

Jun. 26, 2015 (JP) ..... 2015-128212

(51) Int. Cl.
*A45D 29/00* (2006.01)
*B41J 3/407* (2006.01)

(52) U.S. Cl.
CPC ..... *A45D 29/00* (2013.01); *B41J 3/407* (2013.01); *A45D 2029/005* (2013.01)

(58) Field of Classification Search
CPC ..... B41J 3/407; A45D 2029/005; A45D 29/00
See application file for complete search history.

(56) References Cited

U.S. PATENT DOCUMENTS 6,525,724 B1 2/2003 Takami
2012/0147113 A1* 6/2012 Yamasaki ..... A45D 29/00 347/104

FOREIGN PATENT DOCUMENTS

JP 2000194838 A 7/2000

* cited by examiner

*Primary Examiner* — Julian Huffman
(74) *Attorney, Agent, or Firm* — Holtz, Holtz & Volek PC

(57) ABSTRACT

A drawing apparatus includes a drawing unit for drawing on a nail of an object which is a finger or a toe by applying ink, an object suppression unit for applying a suppression force to suppress a motion of the object to the object, and a nail region detection unit for detecting a region of the nail.
The drawing apparatus sets the suppression force to a first suppression force in at least one of a first period of the drawing unit drawing on the nail and a second period of the nail region detection unit detecting the region of the nail, and sets the suppression force to a second suppression force which is weaker than the first suppression force or sets the motion of the object to be not suppressed in a third period of the ink applied to the nail being dried.

16 Claims, 6 Drawing Sheets

FIG. 4

| | |
|---|---|
| FIRST SUPPRESSION FORCE | FIRST PRESSURE VALUE |
| SECOND SUPPRESSION FORCE | SECOND PRESSURE VALUE |

FIG. 5

| | PRESSURE LEVEL OF FINGER SUPPRESSION UNIT |
|---|---|
| NAIL REGION DETECTION 1A | FIRST PRESSURE VALUE |
| BASE COAT DRAWING | FIRST PRESSURE VALUE |
| DRYING 1B | SECOND PRESSURE VALUE |
| NAIL REGION DETECTION 2A | FIRST PRESSURE VALUE |
| INKJET PRINTING | FIRST PRESSURE VALUE |
| DRYING 2B | SECOND PRESSURE VALUE |
| NAIL REGION DETECTION 3A | FIRST PRESSURE VALUE |
| PLOTTER DRAWING | FIRST PRESSURE VALUE |
| DRYING 3B | SECOND PRESSURE VALUE |
| NAIL REGION DETECTION 4A | FIRST PRESSURE VALUE |
| TOP COAT DRAWING | FIRST PRESSURE VALUE (THIRD PRESSURE VALUE) |
| DRYING 4B | SECOND PRESSURE VALUE |

DRAWING APPARATUS, OPERATION CONTROL METHOD OF DRAWING APPARATUS, AND OPERATION CONTROL PROGRAM OF DRAWING APPARATUS

CROSS-REFERENCE TO RELATED APPLICATIONS

This application is based upon, and claims the benefit of priority from, corresponding Japanese Patent Application No. 2015-128212 filed in the Japan Patent Office on Jun. 26, 2015, the entire contents of which are incorporated herein by reference.

BACKGROUND OF THE INVENTION

1. Field of the Invention

The present invention relates to a drawing apparatus, an operation control method of the drawing apparatus, and an operation control program of the drawing apparatus.

2. Description of the Related Art

One technique to hold a fingernail to be drawn in a drawing apparatus that draws a nail design on the fingernail has been proposed. Such drawing apparatus is described in, for example, JP 2000-194838 A.

A nail art apparatus as the drawing apparatus, which includes a holder for locking a finger, is disclosed in the above-described document. The holder includes a function unit for placing the finger and a pair of wing-shaped supporting members that moves in response to motion of the function unit. In the nail art apparatus, a user places his or her finger on the function unit and the function unit moves downward, and accordingly the pair of supporting members has narrower distance from each other. The pair of supporting members holds a fingernail on which a design is drawn.

For such apparatus, a drying treatment takes much time and required time for whole processes increases where the nail design is complicated or where liquid agent is used which ink to be applied to a nail is less likely to be dried. This increases inconvenience for a user while the user's finger is continuously held in a tight state with the finger's motion being strongly suppressed during the time until the whole processes are completed. Unfortunately, no such perspectives regarding reduction of inconvenience for a user are mentioned in the nail art apparatus disclosed in the above-described document.

BRIEF SUMMARY OF THE INVENTION

The present invention has an advantage of providing: a drawing apparatus capable of reducing inconvenience for a user in a state of his or her finger being held during formation of a nail design with the drawing apparatus, an operation control method of the drawing apparatus, and an operation control program of the drawing apparatus.

According to an embodiment of the present invention, there is provided a drawing apparatus including: a drawing unit configured to draw on at least one of nails of an object which is at least one of fingers or at least one of toes by applying ink; an object suppression unit configured to apply a suppression force to suppress a motion of the object to the object; a nail region detection unit configured to detect a region of the nail; and a control unit configured to control the object suppression unit, wherein the control unit (i) sets the suppression force to a first suppression force in at least one of a first period and a second period, the first period being a period in which the drawing unit draws on the nail, the second period being a period in which the nail region detection unit detects the region of the nail, and (ii) sets the suppression force to a second suppression force which is weaker than the first suppression force or sets the motion of the object to be not suppressed in a third period in which the ink applied to the nail is dried.

According to another embodiment of the present invention, there is provided a drawing apparatus including: an object suppression unit configured to apply a suppression force to an object which is at least one of fingers or at least one of toes having at least one of nails, the suppression force being configured to suppress a motion of the object; and a control unit configured to control the object suppression unit, wherein the control unit (i) sets the suppression force to a first suppression force in a first period of which an allowable range of a movement of the object is a first value, and (ii) sets the suppression force to a second suppression force which is weaker than the first suppression force or sets the motion of the object to be not suppressed in a second period of which the allowable range of the movement of the object is a second value greater than the first value.

According to another embodiment of the present invention, there is provided an operation control method for a drawing apparatus, the drawing apparatus including: a drawing unit configured to draw on at least one of nails of an object which is at least one of fingers or at least one of toes by applying ink; an object suppression unit configured to apply a suppression force to the object, the suppression force configured to suppress a motion of the object; and a nail region detection unit configured to detect a region of the nail, the operation control method including: a first step of setting the suppression force to a first suppression force in at least one of a first period and a second period, the first period being a period in which the drawing unit draws on the nail, the second period being a period in which the nail region detection unit detects the region of the nail; and a second step of setting the suppression force to a second suppression force which is weaker than the first suppression force or setting the motion of the object to be not suppressed in a third period in which the ink applied to the nail is dried.

According to another embodiment of the present invention, there is provided a non-transitory computer-readable recording medium storing an operation control program for a drawing apparatus, the drawing apparatus including: a drawing unit configured to draw on at least one of nails of an object which is at least one of fingers or at least one of toes by applying ink; an object suppression unit configured to apply a suppression force to the object, the suppression force being configured to suppress a motion of the object; and a nail region detection unit configured to detect a region of the nail, the operation control program causing the drawing apparatus to perform: a first operation to set the suppression force to a first suppression force in at least one of a first period and a second period, the first period being a period in which the drawing unit draws on the nail, the second period being a period in which the nail region detection unit detects the region of the nail; and a second operation to set the suppression force to a second suppression force which is weaker than the first suppression force or set the motion of the object to be not suppressed in a third period in which the ink applied to the nail is dried.

BRIEF DESCRIPTION OF THE SEVERAL VIEWS OF THE DRAWING

FIG. 2A illustrates a state where no finger is inserted, and FIG. 2B illustrates a state where a finger is inserted and a state before the nail being placed on a nail placement unit, and FIG. 2C illustrates a state where a finger is inserted and the nail is placed on the nail placement unit;

FIG. 4 illustrates a table of a specified pressure value of an object suppression unit according to the embodiment;

FIG. 5 illustrates a table of a specified pressure level of the object suppression unit according to the embodiment;

DETAILED DESCRIPTION OF THE INVENTION

Figure 1:
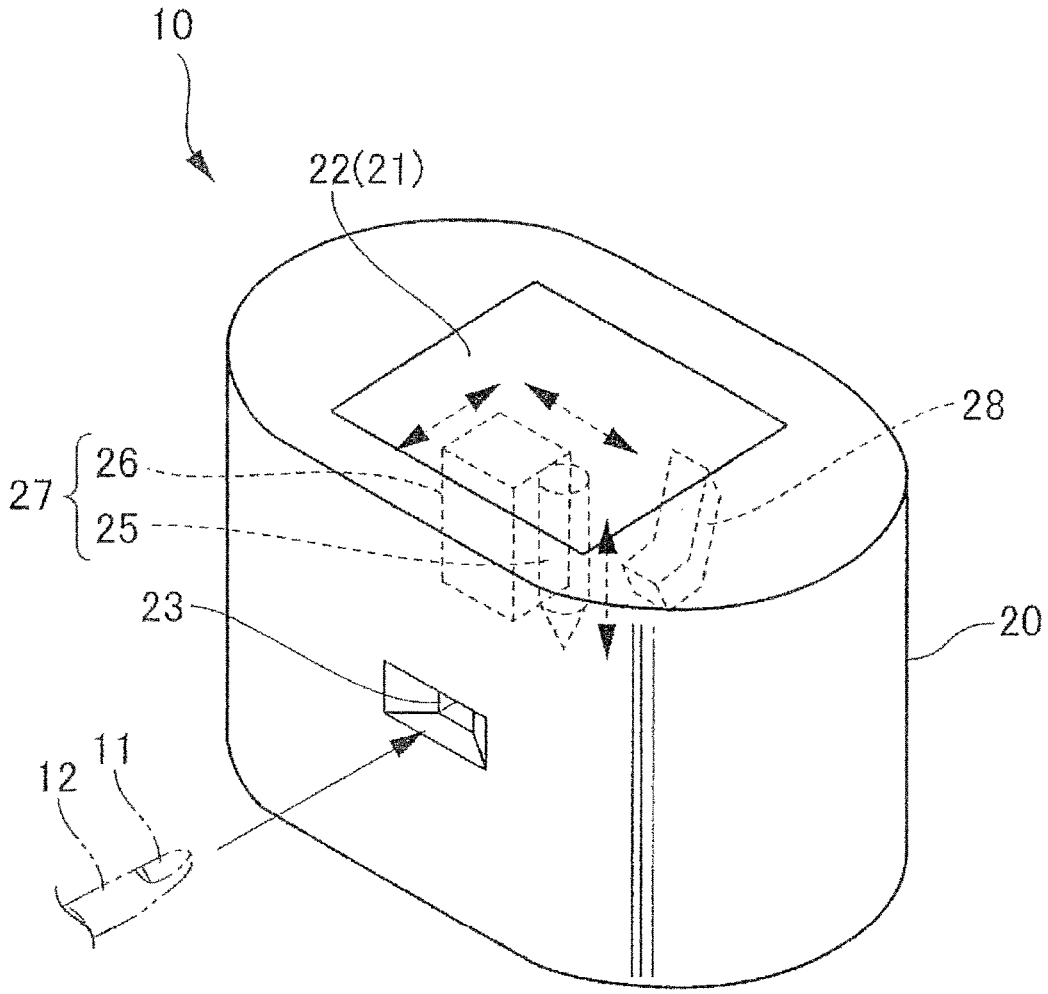
FIG. 1 illustrates a perspective view of appearance of a drawing apparatus according to an embodiment of the present invention.

A detailed description will be given of a drawing apparatus according to the present invention and an embodiment of a detection method of nail tilting in the drawing apparatus with reference to the attached drawings. Like reference numerals designate corresponding or identical elements throughout the description of the embodiment.

In the description of the embodiment described below, a drawing apparatus is assumed to be an apparatus that employs a finger of a hand as an object and draws on a nail of the finger of the hand as a drawing target. However, the object according to the present invention is not limited to a finger of a hand. For example, a finger of a foot may be employed as the object and a nail of the finger of the foot may be employed as the drawing target to be drawn thereon.

Overall Configuration of Embodiment

An overall configuration of the drawing apparatus will be described with reference to FIG. 1. FIG. 1 conceptually illustrates appearance of the drawing apparatus.

As illustrated in FIG. 1, a drawing apparatus 10 is an apparatus, in which a nail design is applied to a nail 11 of a human finger 12.

The drawing apparatus 10 includes a case main body 20 and a display unit 22 of a touch panel type, which is disposed in an upper surface (top plate) of the case main body 20, is also equipped with an operation unit 21.

The case main body 20 includes an object insertion unit 23 opening in a front surface of the case main body 20.

A drawing unit 27 containing a drawing head unit 25 and an inkjet unit 26, and a dryer (drying mechanism) 28 for drying ink applied to the nail 11 with warm air are disposed within the case main body 20. An object holding case 30 (see FIG. 2A), a fluid supply and discharge unit 40 (see FIG. 2A), a controller 50 (see FIG. 3), and an image acquisition unit 51 (see FIG. 3) are additionally housed in the case main body 20.

The drawing head unit 25, the inkjet unit 26, and the dryer 28 are movable to a front and rear direction, a lateral direction, and a vertical direction where appropriate, which are the directions indicated with a dashed line with arrows in FIG. 1, by various moving methods.

Configuration of Object Holding Case and its Periphery

Configurations of the object holding case 30 and its periphery will be described with reference to FIGS. 2A, 2B, and 2C.

Figure 2A:
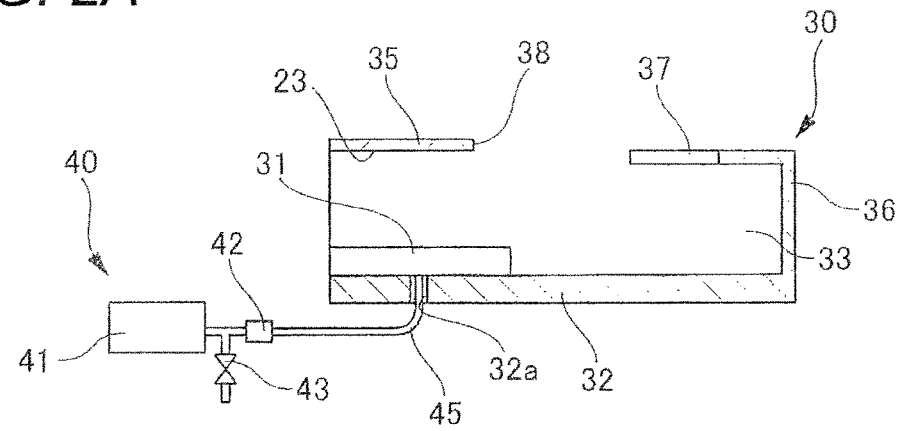
FIGS. 2A, 2B, and 2C illustrate a cross-sectional side view of around an object insertion unit according to the embodiment.

As illustrated in FIG. 2A, the object holding case 30 and the fluid supply and discharge unit 40 are disposed in the case main body 20.

An object suppression unit 31 is arranged in an internal space in the object holding case 30, which is the space for forming the object insertion unit 23.

Figure 2B:
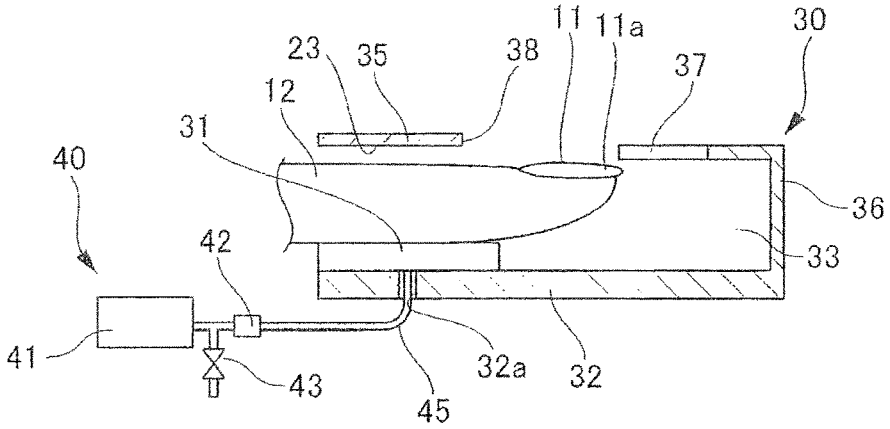
Figure 2C:
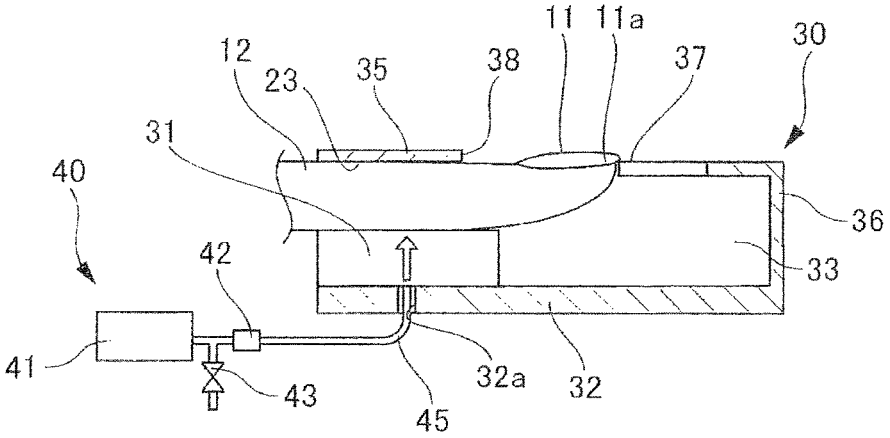

The object holding case 30 includes: a lower wall 32 with a through-hole 32*a*; right and left side walls 33 formed upward from the respective right and left end portions of the lower wall 32 (FIGS. 2A, 2B, and 2C illustrate the only side wall 33 in the left side); an upper wall 35 that connects upper end portions of the right and left side walls 33 in a near side of a finger insertion direction; an innermost wall 36 that connects end portions in a deep side of the finger insertion direction of the right and left side walls 33; and a nail placement unit 37 extending from an upper end of the innermost wall 36 to the near side of the finger insertion direction, on which a nail tip portion 11*a* of the nail 11 is placed.

An opening 38, which upwardly exposes the nail 11 of the finger 12 inserted, is formed between the upper wall 35 and the innermost wall 36.

The object suppression unit 31 is provided with a sheet formed into a shape of a bag, and for example, the sheet having a planar shape is formed into a quadrangular shape.

A tube 45, which is inserted into the through-hole 32*a* from the outside, is connected to a lower side of the object suppression unit 31.

The object suppression unit 31 is configured to expand when fluid is supplied into and shrink when the fluid is discharged from the inside. Various gases and various liquids are available for the fluid. For example, air can be employed for the fluid appropriately.

The fluid supply and discharge unit 40, which is connected to the object suppression unit 31 via the tube 45, includes: a pump 41 (for example, an air pump) for supplying the fluid to the object suppression unit 31 to expand; a pressure sensor 42 for measurement of pressure within the object suppression unit 31; and a valve 43 (for example, solenoid valve) that closes when expanding the object suppression unit 31 and opens to discharge the fluid when shrinking the object suppression unit 31.

As illustrated in FIG. 2B, in a state where the finger 12 is inserted into the object insertion unit 23 and the nail tip portion 11*a* is placed on the nail placement unit 37, the fluid supply and discharge unit 40 first energizes the valve 43 and closes the valve 43.

The fluid supply and discharge unit 40 subsequently energizes the pump 41, concurrently supplies the fluid to the object suppression unit 31 via the tube 45 while measuring the pressure with the pressure sensor 42, and applies pressure to the internal object suppression unit 31. This consequently causes the object suppression unit 31 to expand.

Accordingly, as illustrated in FIG. 2C, the object suppression unit 31 expands to press so as to push up a root side portion of the lower side of the finger 12, presses a portion other than the nail 11 of the upper side of the finger 12 against an inner surface of the upper wall 35, and prevents the finger 12 from moving to suppress its motion.

Figure 3:
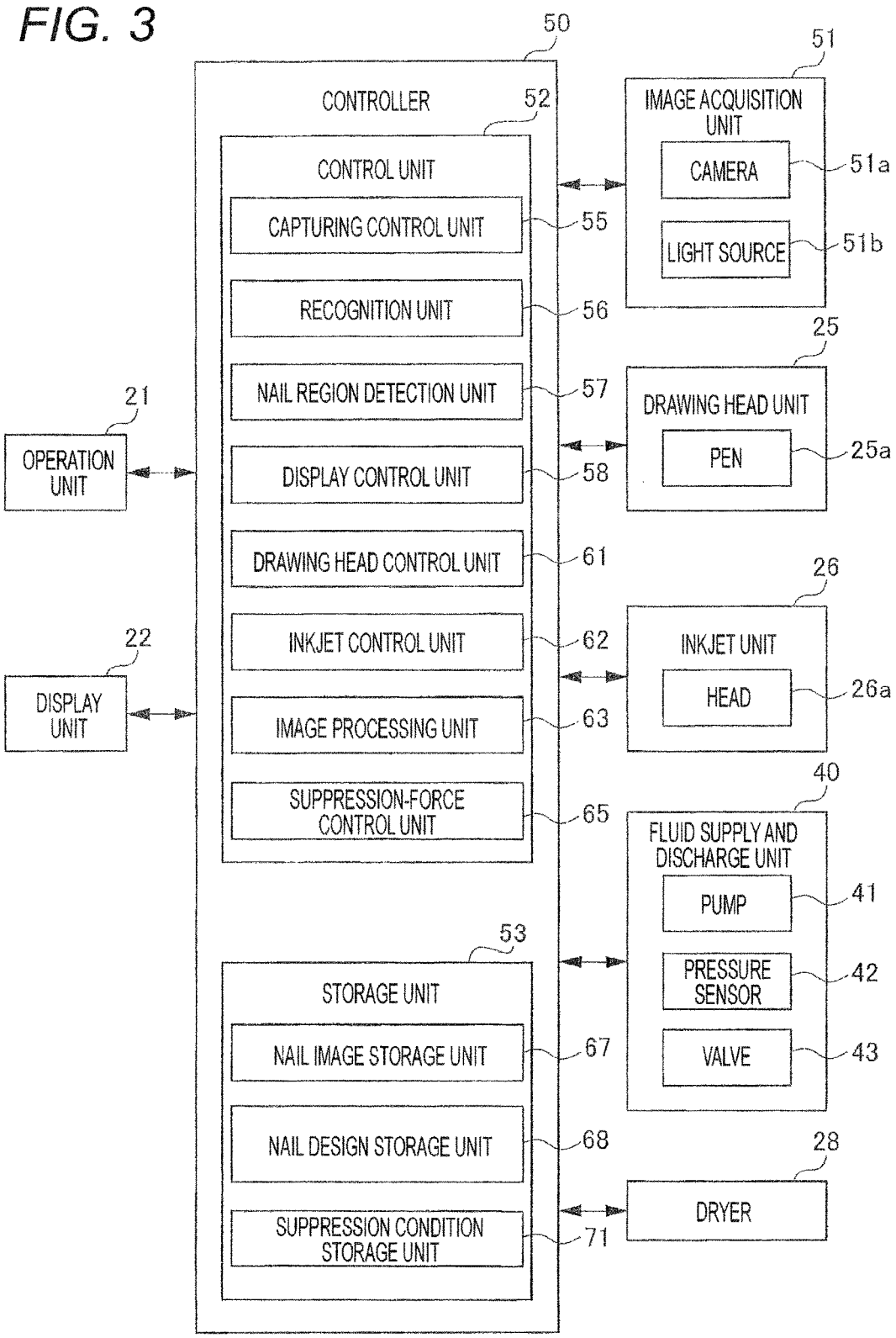
FIG. 3 illustrates a configuration for control according to the embodiment.

A configuration for controlling the drawing apparatus 10 will be described with reference to FIG. 3. FIG. 3 is a block diagram illustrating the configuration for control.

As illustrated in FIG. 3, the controller 50 includes a control unit 52 constituted of a central processing unit (CPU) and a storage unit 53 constituted of such as a read only memory (ROM) and a random access memory (RAM).

The control unit 52 includes a capturing control unit 55, a recognition unit 56, a nail region detection unit 57, a display control unit 58, a drawing head control unit 61, an inkjet control unit 62, an image processing unit 63, and a suppression-force control unit 65.

The above functions of such as the capturing control unit 55, the recognition unit 56, the nail region detection unit 57, the display control unit 58, the drawing head control unit 61, the inkjet control unit 62, the image processing unit 63, and suppression-force control unit 65 are implemented by the CPU of the control unit 52 in coordination with a program stored in the ROM of the storage unit 53.

The operation unit 21, the display unit 22, the image acquisition unit 51, the drawing head unit 25, the inkjet unit 26, the fluid supply and discharge unit 40, and the dryer 28 are connected to the controller 50.

The image acquisition unit 51 includes a camera 51*a* and a light source 51*b* that capture the nail 11 of the finger 12 inserted into the object insertion unit 23 through the opening 38 (see FIGS. 2A, 2B, and 2C).

The drawing head unit 25 includes a pen 25*a* that draws on the nail 11 through the opening 38.

The drawing head unit 25 includes for the nail 11, for example, the pen 25*a* for a base coat (under coat), the pen 25*a* for a top coat, and the pen 25*a* having different colors and various kinds of inks, which enables a drawing of various designs on the nail 11.

The top coat (specific ink) is a protective layer formed with a transparent liquid agent that protects a nail design. The inkjet unit 26 includes a head 26*a* that prints on the nail 11 through the opening 38. The head 26*a* prints the various designs on the nail 11.

The capturing control unit 55 controls the camera 51*a* of the image acquisition unit 51 and the light source 51*b* to capture the finger 12 inserted into the object insertion unit 23 with the camera 51*a* and acquire an image of the finger 12 with the nail 11 and its periphery.

The recognition unit 56 recognizes the nail 11 of the finger 12 inserted into the object insertion unit 23 and determines the existence of the nail 11 in the opening 38 based on such as the image acquired by the image acquisition unit 51.

The nail region detection unit 57 detects a nail region based on the image captured with the camera 51*a*.

The display control unit 58 controls the display unit 22 to cause the display unit 22 to display various screens for the images including the nail region and the nail design capable of being selected.

The drawing head control unit 61 and the inkjet control unit 62 control operations of the pen 25*a* and the head 26*a*, respectively. The pen 25*a* and the head 26*a* respectively draw and print the selected nail design on the nail 11.

The image processing unit 63 scales down and enlarges the nail design selected by a user so as to be matched with the nail region in the image, and generates drawing data.

The suppression-force control unit 65 controls the operations of the pump 41 and the valve 43 of the fluid supply and discharge unit 40 to control suppression force of the object suppression unit 31 (pressure within the object suppression unit 31).

The suppression-force control unit 65 at least sets the suppression force to a first suppression force to control so as to relatively strongly suppress the motion of the finger 12 with the object suppression unit 31. Additionally, the suppression-force control unit 65 sets the suppression force to a weaker second suppression force than the first suppression force to control so as to relatively weakly suppress the motion of the finger 12 with the object suppression unit 31.

In this example, the suppression-force control unit 65 sets the suppression force with the object suppression unit 31 to the first suppression force to control for securely suppressing the motion of the finger 12 so as to prevent the finger 12 from easily moving while the nail region detection unit 57 detects the nail region of the nail 11 (second period). More specifically, it is necessary for the nail 11 to remain in a fixed condition at this time. An allowable range of a movement of the nail 11 in this process is zero or a very small value. Therefore, the control for securely suppressing the motion of the finger 12 is performed.

The suppression-force control unit 65 additionally sets the suppression force with the object suppression unit 31 to the first suppression force to control for securely suppressing the motion of the finger 12 so as to prevent the finger 12 from easily moving also while the drawing unit 27 applies the ink to the nail 11 (first period). More specifically, it is necessary for the nail 11 to remain in a fixed condition also at this time, similarly to the time during the above-described detection of the nail region of the nail 11. The allowable range of the movement of the nail 11 in this process is also zero or a very small value. Therefore, the control for securely suppressing the motion of the finger 12 is performed.

On the other hand, after completion of applying the ink to the nail 11 by the drawing unit 27, the suppression-force control unit 65 sets the suppression force with the object suppression unit 31 to the second suppression force to control for moderately suppress the motion of the finger 12, in a drying period for drying the ink completed to be applied (third period). In other words, the nail 11 may slightly move at this time. Accordingly, the allowable range of the movement of the nail 11 in this process is a larger value than that of the time during the detection of the nail region of the above-described nail 11 and the time during the application of the ink to the nail 11. Therefore, the control for more moderately suppressing the motion of the finger 12 than that of the time during the detection of the nail region of the nail 11 and the time during the application of the ink to the nail 11 is performed.

The suppression force is set to the second suppression force and the control for moderately suppressing the motion of the finger 12 is performed in the drying period, as above-described. However, it is not limited to the above, and for example, the state where the motion of the finger 12 is not suppressed with the suppression force of zero or an actual zero may be employed.

The first suppression force is set to a relatively high pressure value enabling the motion of the finger 12 to be securely suppressed so as to prevent the finger 12 from actually moving by the object suppression unit 31. On the other hand, the second suppression force is set to enough relatively low pressure value so that: the finger 12 does not easily comes out of the object suppression unit 31, the finger 12 is capable of slightly moving in the object insertion unit 23 and the user is less likely to feel his or her finger tighten, and the motion of the finger 12 is suppressed more moderately than that of the time of the first suppression force. For example, the value of equal to or more than 100 mmHg is suitable for the second suppression force.

The storage unit 53 stores the various programs and various data for operation of the drawing apparatus 10.

The ROM of the storage unit 53 stores the various programs, which implement the functions of that the suppression-force control unit 65 controls for causing the object suppression unit 31 to set the suppression force to the first suppression force and strongly suppress the motion of the finger 12, and controls for causing the object suppression unit 31 to set the suppression force to the weaker second suppression force than the first suppression force and moderately suppress the motion of the finger 12. The above programs are executed by the controller 50, which causes each unit of the drawing apparatus 10 to be collectively controlled.

The storage unit 53 includes a nail image storage unit 67 for storing the user's nail region acquired by the image acquisition unit 51 and a nail design storage unit 68 for storing the plurality of nail designs. The storage unit 53 also includes a suppression condition storage unit 71.

The suppression condition storage unit 71 stores a table of a specified pressure value (see FIG. 4) of the object suppression unit 31 which indicates pressure values (first pressure value and second pressure value) corresponding to each of the first suppression force and the second suppression force.

The first pressure value corresponding to the first suppression force is set to 150 mmHg, for example. The second pressure value corresponding to the second suppression force is set to 100 mmHg, for example.

The suppression condition storage unit 71 stores a table of a specified pressure level (see FIG. 5) of the object suppression unit 31 which corresponds to each step for application of the nail design to the nail 11.

The first pressure value and the second pressure value are shown here by way of example. This should not be construed in a limiting sense. The suitable values of the first pressure value and the second pressure value vary even with such as a structure of an apparatus and also vary even with, for example, a thickness of a user's finger and preference of a user. Accordingly, it is preferred that the first pressure value and the second pressure value are the values capable of being controlled by the user rather than fixed values.

Operations of Embodiment

An operation control method of the drawing apparatus 10 will be described with reference to FIG. 6.

Figure 6:
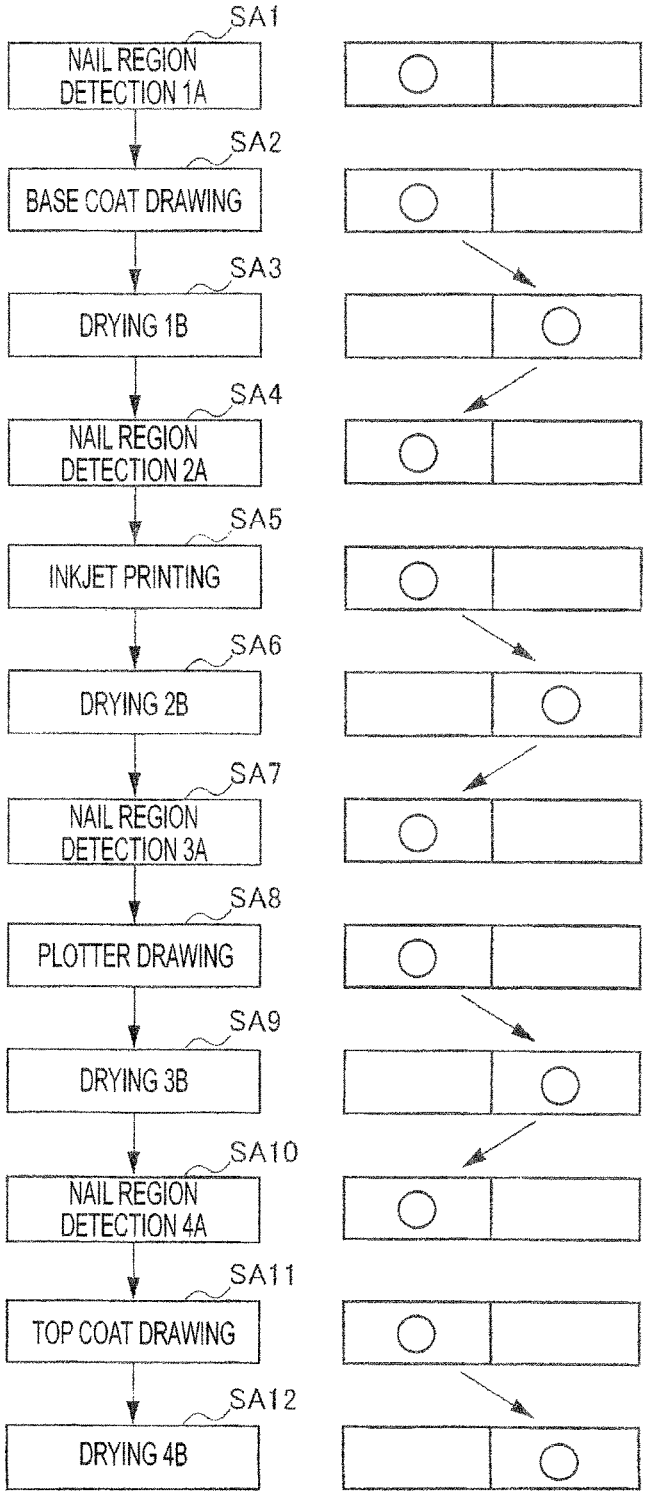
FIG. 6 illustrates a flowchart according to the embodiment and a state of the object suppression unit corresponding to each step.

FIG. 6 is a flowchart illustrating operations of the drawing apparatus.

In "State of Object Suppression Unit" illustrated in the right side of the flowchart in FIG. 6, a circle "O" is shown in the left side to indicate that the suppression force is set to "First suppression force (First pressure value)", and a circle "O" is shown in the right side to indicate that the suppression force is set to "Second suppression force (Second pressure value)".

The following steps SA1 to SA12 are performed in the state where the finger 12 is inserted into the object insertion unit 23.

The object suppression unit 31 is expanded and the finger 12 is suppressed so as to prevent the nail 11 placed on the nail placement unit 37 from moving. As illustrated in FIG. 6, in step SA1, a nail region detection 1A is performed in the state where the motion of the finger 12 is securely suppressed by the pressure (first pressure value) being set.

The time taken by performing the nail region detection 1A of step SA1 is about 10 seconds, for example. The same applies to the subsequent steps SA4, SA7, and SA10.

The acquisition of the specified pressure level in step SA1 and the pressure value setting of the object suppression unit 31 will be described in more detail.

Figure 7:
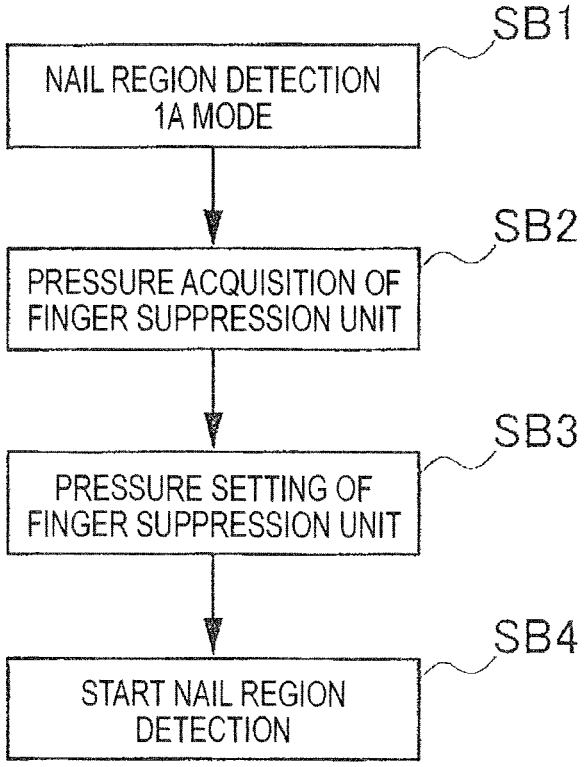
FIG. 7 illustrates a flowchart of nail region detection according to the embodiment.

As illustrated in FIG. 7, for the nail region detection 1A, when a process proceeds to a mode of the nail region detection 1A in step SB1, the pressure level of the nail region detection 1A is acquired from the table of the specified pressure level (see FIG. 5) of the object suppression unit 31 in step SB2.

The first pressure value as the pressure level is acquired here.

In step SB3, the first suppression force corresponds to the first pressure value (for example, 150 mmHg) based on the table of the specified pressure value (see FIG. 4) of the object suppression unit 31, and accordingly the pressure value of the object suppression unit 31 is set to the first pressure value.

In step SB4, the nail region detection is initiated upon the object suppression unit 31 having reached the first pressure value.

The acquisition of the specified pressure level in step SA1 (see FIG. 6) and the pressure value setting have been described here with the examples. Similarly, the acquisition of the specified pressure level and the pressure value setting are performed based on the table of the specified pressure level (see FIG. 5) and the table of the specified pressure value (see FIG. 4) also in steps SA2 to SA12.

Referring back to FIG. 6.

In step SA2, the finger 12 is suppressed while the suppression force is maintained at the first suppression force, and the drawing head unit 25 draws the base coat for an inkjet, as illustrated in FIG. 6.

The time taken by drawing the base coat in step SA2 is about 30 seconds to about 60 seconds, for example.

In step SA3, the ink applied to the nail 11 is dried with the dryer 28 (drying 1B).

In a drying step of the drying 1B, the second pressure value as the pressure level of the drying 1B is acquired from the table of the specified pressure level (see FIG. 5) of the object suppression unit 31.

The second suppression force of the suppression force corresponds to the second pressure value (for example, 100 mmHg) based on the table of the specified pressure value (see FIG. 4) of the object suppression unit 31, and accordingly the pressure value of the object suppression unit 31 is set to the second pressure value.

In the drying step of the drying 1B, the ink applied to the nail 11 is dried in the state where the object suppression unit 31 moderately suppresses the motion of the finger 12 with the pressure of the second pressure value.

The drying time in step SA3 is about 30 seconds, for example. (The same applies to the subsequent steps SA6, SA9, and SA12.)

In the drying step of the drying 1B, the drying may be initiated before changing the pressure value of the object suppression unit 31 and then the pressure value may be changed.

In step SA4, the suppression force is set to the first suppression force, the motion of the finger 12 is securely suppressed, and then a nail region detection 2A is initiated, in the same manner as step SAL In step SA5, the inkjet unit 26 prints on the nail 11 while the suppression force is maintained at the first suppression force and the motion of the finger 12 is securely suppressed. The time taken by printing in step SA5 is about 10 seconds, for example.

In step SA6, the suppression force is set to the second suppression force and the ink applied to the nail 11 is dried with the dryer 28 (drying 2B) in the state where the motion of the finger 12 is moderately suppressed, in the same manner as step SA3.

In step SA7, the suppression force is set to the first suppression force and a nail region detection 3A is initiated in the state where the motion of the finger 12 is securely suppressed, in the same manner as step SA1.

In step SA8, the drawing head unit 25 draws with various colors (for example, gold color) on the nail 11 while the suppression force is maintained at the first suppression force and the motion of the finger 12 is securely suppressed.

The time taken by drawing in step SA8 is about 10 seconds, for example.

In step SA9, the suppression force is set to the second suppression force and the ink applied to the nail 11 is dried with the dryer 28 (drying 3B) in the state where the motion of the finger 12 is moderately suppressed, in the same manner as step SA3.

In step SA10, the suppression force is set to the first suppression force, the motion of the finger 12 is securely suppressed, and then a nail region detection 4A is initiated, in the same manner as step SA1.

In step SA11, the drawing head unit 25 draws the top coat on whole region of the nail 11 to protect the nail design while the suppression force is maintained at the first suppression force and the motion of the finger 12 is securely suppressed.

The time taken by drawing the top coat in step SA11 is approximately 10 seconds to 30 seconds.

In step SA12, the suppression force is set to the second suppression force and the ink applied to the nail 11 is dried with the dryer 28 (drying 4B) in the state where the motion of the finger 12 is moderately suppressed, in the same manner as step SA3.

Steps SA1, SA2, SA4, SA5, SA7, SA8, SA10, and SA11 among the above-described steps SA1 to SA12 are equivalent to "Steps performed with setting finger suppression force of an object suppression unit to a first suppression force" mentioned in the present invention. Steps SA3, SA6, SA9, and SA12 are equivalent to "Steps performed with setting finger suppression force of an object suppression unit to a smaller second suppression force than a first suppression force".

In this example, the suppression force is set to the first suppression force and the second suppression force at two levels. However, it is not limited to this aspect, and the suppression force may be also set at three or more levels.

For example, the above-described operation control method is configured to set the suppression force to the first suppression force and securely suppress the motion of the finger 12 whenever the drawing head unit 25 and the inkjet unit 26 draw and print respectively. In contrast, for example, small misalignment of a drawing position on the nail 11 due to a slight motion of the nail 11 is not clearly recognized in a top coat drawing (step SA11) that draws the top coat having transparency on the relatively large region or whole region of the nail 11.

In the step in which the small misalignment of the drawing position on the nail 11 is allowable as above, the suppression-force control unit 65 may set the suppression force to a third suppression force (median force between the first suppression force and the second suppression force) that is weaker than the first suppression force and stronger than the second suppression force to control with the object suppression unit 31 so as to more moderately suppress the motion of the finger 12 than that of the case where the suppression force is the first suppression force.

In this case, the suppression-force control unit 65, for example, sets the suppression force with the object suppression unit 31 to the first suppression force to control for securely suppressing the motion of the finger 12 while the drawing unit 27 applies the ink other than the top coat to the nail 11. The top coat may not be necessary depending on finished quality of the requested nail design. It is possible to appropriately select whether the top coat is required.

Effect of Embodiment

The embodiment that has been described above will now be additionally described.

For the operation control method of the above-described drawing apparatus 10, it takes approximately 30 seconds, depending on the applied ink, for a typical water based ink to be dried with warm air in each of the drying steps of the drying 1B to the drying 4B (steps SA3, SA6, SA9, and SA12).

Accordingly, assuming that it takes 30 seconds for each drying, the total drying time of the four times of drying steps of the drying 1B to the drying 4B is approximately 2 minutes.

Assuming that it takes a total of approximately 1 minute for the four times of drawing and printing including the drawing with the drawing head unit 25 (steps SA2, SA8, and SA11) and the printing with the inkjet unit 26 (step SA5), the motion of the finger 12 is suppressed for a total of approximately 3 minutes including the drying time of 2 minutes.

If an apparatus is employed, which continuously keeps the motion of the finger 12 securely suppressed for 3 minutes (for example, the motion of the finger continues to be securely suppressed in the state where the suppression force is set to the first suppression force), inconvenience for a user increases.

In this respect, the suppression force is set to the first suppression force and the motion of the finger 12 is securely suppressed only when necessary to prevent the nail 11 from moving (steps of the nail region detection 1A to the nail region detection 4A, and steps of the drawing and printing with the drawing head unit 25 and the inkjet unit 26) in the embodiment. On the other hand, the suppression force is set to the second suppression force and the motion of the finger 12 is relatively moderately suppressed in the four times of drying steps (drying 1B to drying 4B) in which the motion of the finger 12 has no need to be securely suppress.

Thus, the finger 12 is securely suppressed discontinuously when needed rather than the finger 12 being securely suppressed continuously for a long time. This ensures the reduced inconvenience for a user compared with the continuous secure suppression of the finger 12.

What is claimed is:

1. A drawing apparatus comprising:

a drawing device configured to draw on at least one of nails of an object which is at least one of fingers or at least one of toes by applying ink;

an object suppression device configured to apply a suppression force to the object for suppressing a motion of the object;

a controller configured to control detection of a region of the nail and to control the object suppression device; and a dryer configured to dry the ink applied to the nail, wherein the controller:

(i) sets the suppression force to a first suppression force in at least one of a first period and a second period, the first period being a period in which the drawing device draws on the nail, and the second period being a period in which the controller controls detection of the region of the nail, and (ii) sets the suppression force to a second suppression force which is weaker than the first suppression force or sets the motion of the object to be not suppressed in at least a part of a third period in which the ink applied to the nail is dried by the dryer.

2. The drawing apparatus according to claim 1, wherein the controller sets the suppression force to the first suppression force in the second period.

3. The drawing apparatus according to claim 2, wherein the controller controls detection of the region of the nail after the suppression force is set to the first suppression force.

4. The drawing apparatus according to claim 1, wherein the controller sets the suppression force to the first suppression force throughout the first period and the second period.

5. The drawing apparatus according to claim 1, wherein the controller sets the suppression force to a third suppression force in at least a part of a fourth period in which the drawing device applies a transparent top coat to the nail, the third suppression force being weaker than the first suppression force and being stronger than the second suppression force.

6. A drawing apparatus comprising:

a drawing device configured to draw on a nail by applying ink;

a dryer configured to dry the ink applied to the nail by the drawing device;

an object suppression device configured to apply a suppression force to an object which is at least one of fingers or at least one of toes having at least one of nails, the suppression force being configured to suppress a motion of the object; and a controller configured to control the object suppression device and to control detection of a region of the nail, wherein the controller:

(i) sets the suppression force to a first suppression force in a first period which comprises at least one of a period in which the drawing device applies the ink to the nail and a period in which the controller controls to detect a position of the region of the nail, and in which an allowable range of a movement of the object is a first value, and (ii) sets the suppression force to a second suppression force which is weaker than the first suppression force or sets the motion of the object to be not suppressed in a second period which comprises a period in which the dryer dries the ink and in which the allowable range of the movement of the object is a second value greater than the first value.

7. An operation control method for a drawing apparatus, the drawing apparatus comprising a drawing device configured to draw on at least one of nails of an object which is at least one of fingers or at least one of toes by applying ink, an object suppression device configured to apply a suppression force to the object for suppressing a motion of the object, a controller configured to control detection of a region of the nail, and a dryer configured to dry the ink applied to the nail, and the method comprising:

a first step of setting the suppression force to a first suppression force in at least one of a first period and a second period, the first period being a period in which the drawing device draws on the nail, and the second period being a period in which the controller controls detection of the region of the nail; and a second step of setting the suppression force to a second suppression force which is weaker than the first suppression force or setting the motion of the object to be not suppressed in a third period in which the ink applied to the nail is dried by the dryer.

8. The method according to claim 7, further comprising:

setting the suppression force to the second suppression force in at least a part of the third period, in the second step.

9. The method according to claim 7, further comprising:

setting the suppression force to the first suppression force in the second period, in the first step.

10. The method according to claim 9, wherein the controller controls detection of the region of the nail after the suppression force is set to the first suppression force in the first step.

11. The method according to claim 7, further comprising:

setting the suppression force to the first suppression force throughout the first period and the second period, in the first step.

12. The method according to claim 7, further comprising:

a third step of setting the suppression force to a third suppression force in at least a part of a fourth period in which the drawing device applies a transparent top coat to the nail, the third suppression force being weaker than the first suppression force and being stronger than the second suppression force.

13. A non-transitory computer-readable recording medium storing an operation control program for a drawing apparatus, the drawing apparatus comprising a drawing device configured to draw on at least one of nails of an object which is at least one of fingers or at least one of toes by applying ink, an object suppression device configured to apply a suppression force to the object for suppressing a motion of the object, a controller configured to control detection of a region of the nail, and a dryer configured to dry the ink applied to the nail, and the operation control program being executable to control the drawing apparatus to perform operations comprising:

a first operation to set the suppression force to a first suppression force in at least one of a first period and a second period, the first period being a period in which the drawing device draws on the nail, and the second period being a period in which the controller controls detection of the region of the nail; and a second operation to set the suppression force to a second suppression force which is weaker than the first suppression force or set the motion of the object to be not suppressed in a third period in which the ink applied to the nail is dried by the dryer.

14. The non-transitory computer-readable recording medium according to claim 13, wherein:

the suppression force is set to the second suppression force which is weaker than the first suppression force in at least a part of the third period, in the second operation, and the program is executable to further control the drawing apparatus to perform a third operation to set the suppression force to a third suppression force in at least a part of a fourth period in which the drawing device applies a transparent top coat to the nail, the third suppression force being weaker than the first suppression force and being stronger than the second suppression force.

15. A drawing apparatus comprising:

a drawing device configured to draw on at least one of nails of an object which is at least one of fingers or at least one of toes by applying ink;

an object suppression device configured to apply, to the object, a suppression force to suppress a motion of the object;

a dryer configured to dry the ink applied to the nail; and a controller configured to control detection of a region of the nail and to control the object suppression device and the dryer, wherein the controller:

(i) sets the suppression force to a first suppression force in at least one of a first period and a second period, the first period being a period in which the drawing device draws on the nail, and the second period being a period in which the controller controls detection of the region of the nail, and (ii) sets the suppression force to a second suppression force which is weaker than the first suppression force or sets the motion of the object to be not suppressed in a third period in which the ink applied to the nail is dried by the dryer.

16. A drawing apparatus comprising:

an object suppression device configured to apply a suppression force to an object which is at least one of fingers or at least one of toes having at least one of nails, the suppression force being configured to suppress a motion of the object;

a controller configured to control the object suppression device;

a drawing device configured to draw on the nail by applying ink; and a dryer configured to dry the ink applied to the nail by the drawing device;

wherein the controller:

(i) sets the suppression force to a first suppression force in a first period in which an allowable range of a movement of the object is a first value, and (ii) sets the suppression force to a second suppression force which is weaker than the first suppression force or sets the motion of the object to be not suppressed in a second period in which the allowable range of the movement of the object is a second value greater than the first value, the second period comprising a period in which the dryer dries the ink.

* * * * *